United States Patent [19]

Soong

[11] Patent Number: 5,014,987

[45] Date of Patent: May 14, 1991

[54] FRAME FOR SPORTS RACKET

[76] Inventor: Tsai C. Soong, 1839 Jackson Rd., Penfield, N.Y. 14526

[21] Appl. No.: 364,630

[22] Filed: Jun. 12, 1989

Related U.S. Application Data

[63] Continuation of Ser. No. 424,459, Sep. 27, 1982, abandoned.

[51] Int. Cl.[5] ..... A63B 49/06

[52] U.S. Cl. ..... 273/73 C; 273/73 D

[58] Field of Search ..... 273/73 R, 73 C, 73 H, 273/73 K, 73 J, 73 D, 211, 212

[56] References Cited

U.S. PATENT DOCUMENTS

| | | | |
|---|---|---|---|
| 1,497,148 | 6/1924 | Kenyon et al. | 273/73 H |
| 1,937,787 | 12/1933 | Robinson | 273/73 H |
| 3,702,189 | 11/1972 | Galich | 273/73 J |
| 3,809,402 | 5/1974 | Haines et al. | 273/73 H X |
| 3,840,230 | 10/1974 | Schaefer et al. | 273/73 C X |
| 3,917,267 | 11/1975 | McGrath | 273/730 X |
| 4,006,260 | 1/1978 | Rodgers | 273/73 C |
| 4,165,071 | 8/1979 | Frolow | 273/73 C |
| 4,291,574 | 9/1981 | Frolow | 273/73 C X |
| 4,836,543 | 6/1989 | Holzer | 273/73 C |
| 4,903,967 | 2/1990 | Ferrari et al. | 273/73 C |

FOREIGN PATENT DOCUMENTS

| | | | |
|---|---|---|---|
| 16315 | 3/1935 | Australia | 273/73 J |

*Primary Examiner*—Edward M. Coven
*Assistant Examiner*—William E. Stoll
*Attorney, Agent, or Firm*—Bernard A. Chiama

[57] ABSTRACT

A sports racket frame shaped to extend around a ball-hitting region covered by a string network has an outer perimeter region forming an anchorage for the strings, which otherwise clear the frame inward of their anchorage. Support regions of the frame extending inward from the outer perimeter region on opposite sides of the plane of the string network provide structural support for the anchorage region. The support regions are formed to provide clearance from the string network, and the clearance of the support regions has a depth measured from an inner perimeter region of the frame outward toward the anchorage region that, at least in lateral side regions of the frame extending along lateral sides of the string network, is at least 0.25 inches. The supporting sides are formed with triangular shaped openings leaving the remaining panel sections of the sides inclined to form a truss.

4 Claims, 9 Drawing Sheets

(d)

BENDING MOMENT ACTING ON THE SECTION ABOUT THE VERTICAL AXIS Z THROUGH THE C.G. OF THE SECTION DUE TO STRING LOAD OF 80 LBS. EACH STRING.

AXIAL FORCE PERPENDICULAR TO THE FRAME SECTION, $F_x$, AT DIFFERENT NODAL POINTS FOR STRING TENSION AT 80 POUNDS

TWISTING TORQUE, $M_x$, APPLIED ABOUT THE LONGITUDINAL AXIS x OF THE FRAME SECTION DUE TO THE STEADY BALL FORCE OF 100 POUNDS ON THE RACKET.

BENDING MOMENT ACTING ON THE SECTION ABOUT THE y-AXIS, $M_y$, DUE TO A STEADY BALL FORCE OF 100 POUNDS ON THE RACKET.

RACKET DEFLECTION AT BALL LOAD 100 POUNDS

FRAME FOR SPORTS RACKET

This is a continuation of application Ser. No. 424,459, filed Sept. 27, 1982, now abandoned.

BACKGROUND

Frames for sports rackets, and particularly for tennis rackets, present an engineering challenge. They must be strong enough to withstand enormous loads, be as nearly rigid as possible, and yet use only a few ounces of material. For example, a conventional tennis racket weighs approximately 12.5 to 14.5 ounces; and its center of gravity is in the vicinity of its throat, which makes the weight attributed to the frame extending around the ball-hitting region from 6 to 7 ounces. These few ounces of material must sustain a tremendous string load of up to 80 pounds per string and a ball-hitting load of 100 pounds or more, repeated for perhaps 40,000 shots without a failure. Understandably, sports racket frames have not yet fully met such a challenge.

Steel frame rackets are known to be too flexible or "whippy". Since steel is heavy, its walls have to be made thin to remain light in weight, giving its frame section insufficient moment of inertia for resisting bending and torsion loads.

Frame sections formed of aluminum alloy can have thicker walls and be more rigid, but they tend to permanently deform due to lower yield strength. Alcoa heat-treatable 60-T6 series or 70 series improve the strength of aluminum considerably, but not enough to eliminate frame problems.

Graphite and composite materials, although expensive, have produced frame strips of very high strength-to-weight ratios that increase possible alternatives.

Frame strips presently used in metal rackets fall into two categories--oval or rectangular tubular section and I-beam section with solid or tubular flanges. For the latter, the tubular flange on both ends of the web provides torsional and bending rigidity resisting ball impact; and the thick web provides a bearing seat supporting string holes. Although quite popular, the I-beam section has the inherent problem of a marginal moment of inertia to resist the pulling load from the strings in the plane of the string surface, since most of the sectional mass is along the longitudinal axis of the frame to provide a solid seating for the strings. For example, the moment-of-inertia ratio between the axis perpendicular to the web and the axis coinciding with the web for the HEAD EDGE racket frame section is 7.6 to 1.0.

For a rectangular tubular frame section, the disparity between moments of inertia along the two principal axes is not as drastic as for I-beam type frames, but even these are usually narrowed in the middle of the section to provide the necessary string support. Graphite rackets also follow the general geometry of metal tubing frames, and they too have a narrow neck where the string hole is bored through the frame strip.

I have thoroughly studied the problems of sports racket frames, and tennis racket frames in particular, and have used the finite-element structural mechanical analysis method to study the loads imposed on a tennis racket from the strings and from the impact of the ball. Through such analysis, I have discovered a better cross-sectional shape for a racket frame having several important advantages. My analysis not only revealed the weaknesses of conventional racket frames, but showed that frames having an improved cross-sectional shape can be made stronger and more rigid without increasing weight, even though still using existing materials.

Another important advantage of my improved frame section is a longer free vibrational length for the strings which substantially improves the performance of the string network. By keeping the free vibrational length of the strings to a maximum within the overall size limitations of a particular racket frame and by making the frame stronger and more rigid, my invention adds considerably to the performance of racket frames.

SUMMARY OF THE INVENTION

My invention applies to a sports racket frame shaped as usual to extend around a ball-hitting region covered by a string network supported by the frame. An outer perimeter region of the frame forms an anchorage for the strings of the network, and a support region of the frame extends inward from the outer perimeter region toward the ball-hitting region. The support region has side regions extending on opposite sides of the plane of the string network and providing structural support for the anchorage region. The support region is formed to provide clearance from the strings, and the clearance has a depth measured from an inner perimeter region of the support region outward toward the anchorage region. This string clearance depth, at least in lateral side regions of the frame extending along lateral sides of the string network, is at least 0.25 inches, and preferably more. The support region can be formed as an open channel having spaced apart channel edges clearing the strings, and the inner perimeter of the support region can include a wall extending between the side regions and formed to provide string clearance.

DRAWINGS

Figure 1:
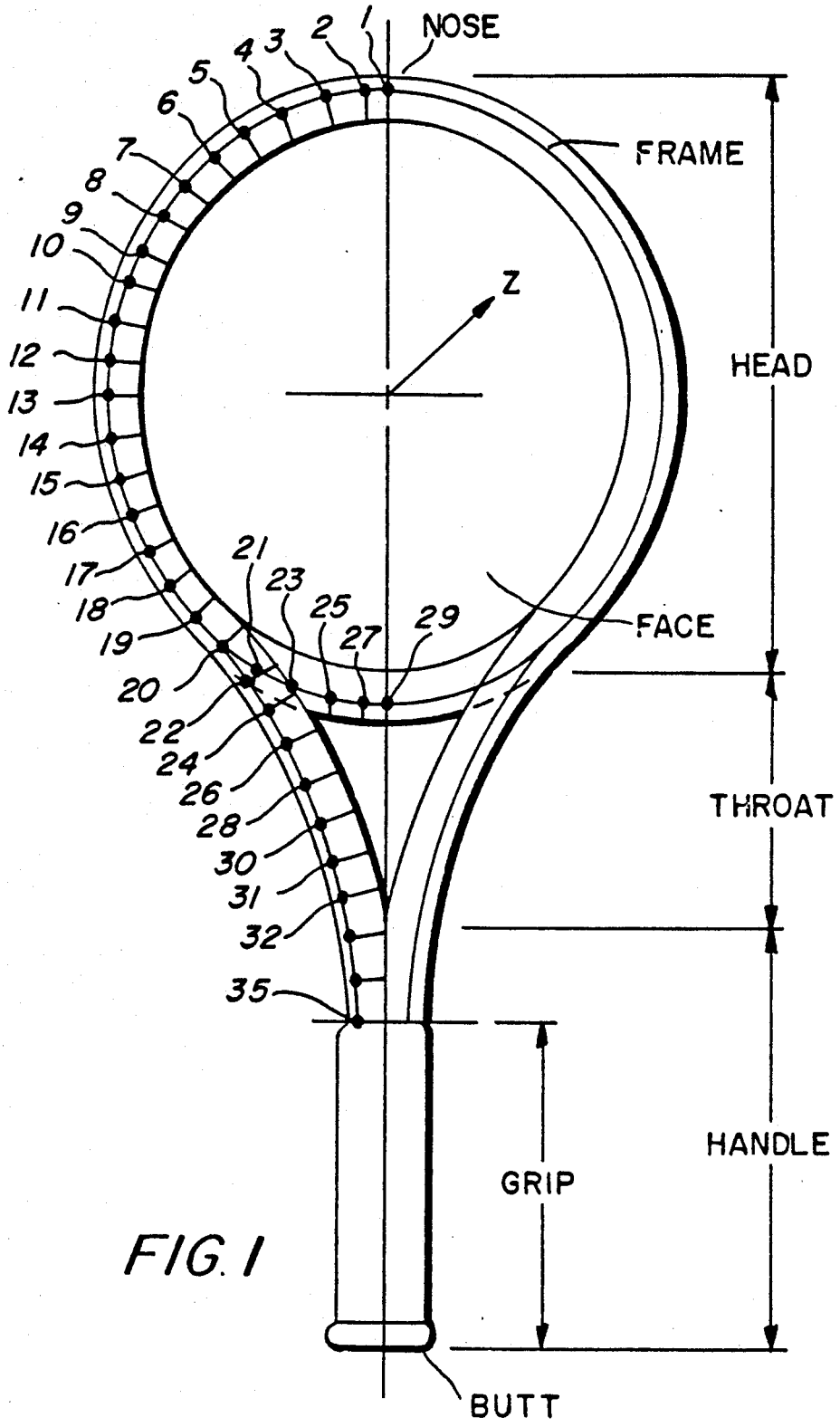
FIG. 1 is a plan view of a tennis racket made according to my invention with variable frame strip dimensions and labeled to identify regions of the racket and nodal points used in my analysis.
Figure 5:
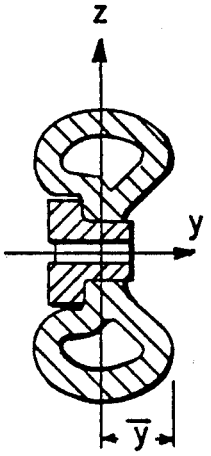
FIG. 5 PRIOR ART
Figure 17:
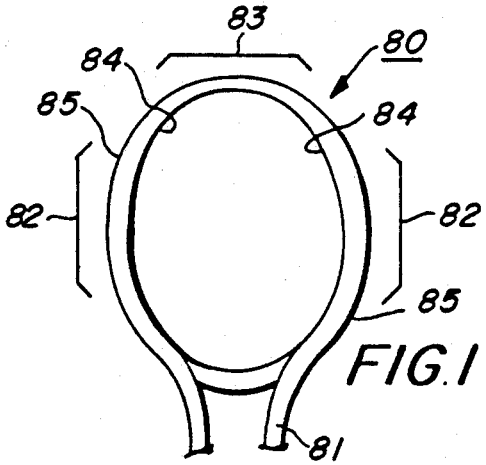
Figure 6:
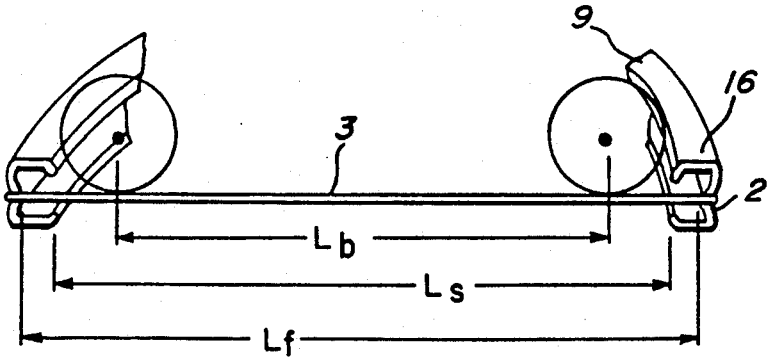
Figure 11:
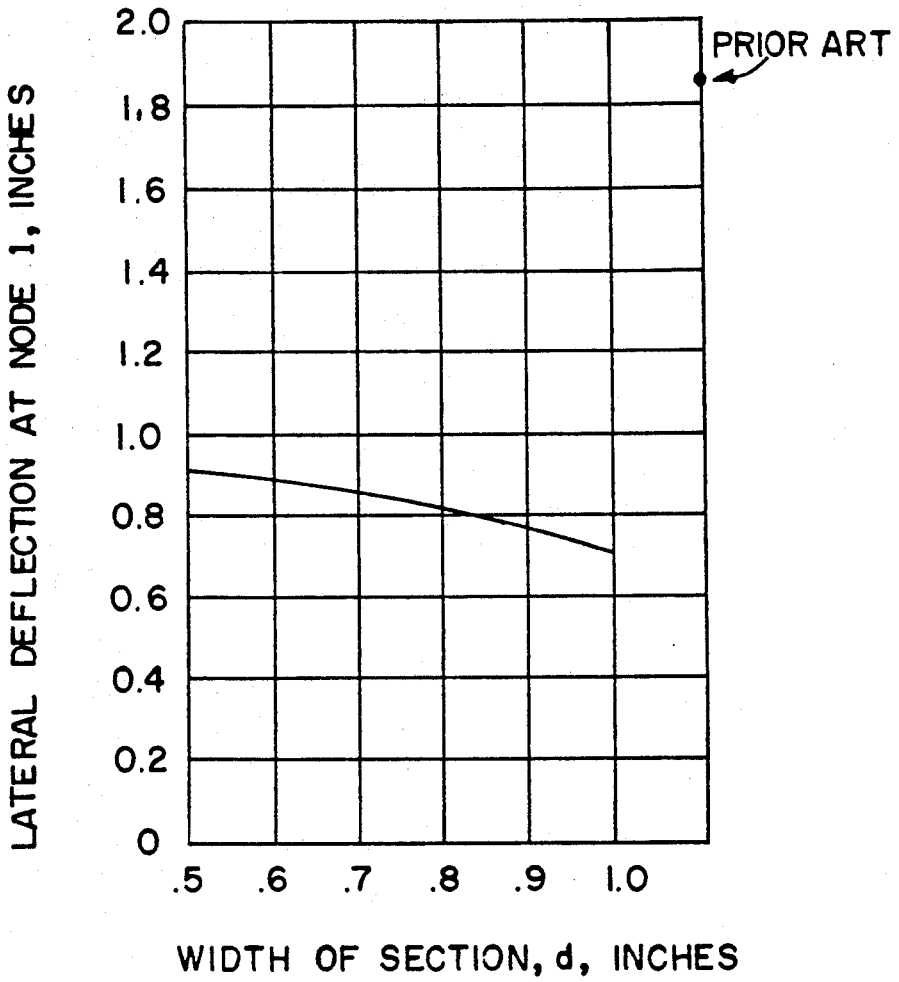
Figure 15:
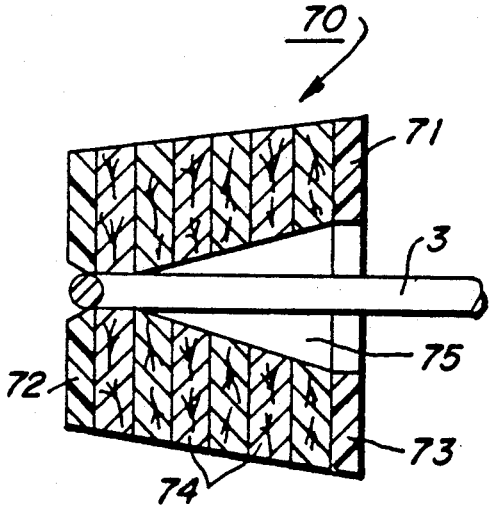
Figure 16:
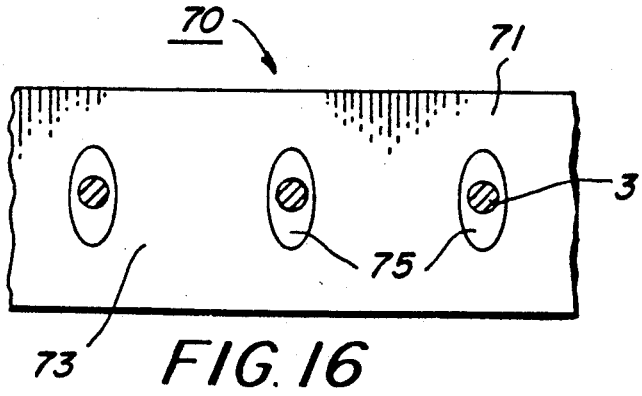

FIG. 5 is a frame cross section taken from U.S. Pat. No. 3,899,172 as typical of prior art hollow tubular I-beam type tennis racket frames;

FIG. 6 is a partially schematic, cross-sectional view of a tennis racket frame according to my invention and labeled to show measurements used in analysis and explanation;

FIGS. 7–10 are graphic displays of forces acting on the numbered nodal points of a preferred tennis racket made according to my invention and illustrated in FIG. 1;

FIG. 11 is a graphic display of lateral deflection of the racket of FIG. 1 compared with prior art rackets;

FIGS. 12–15 are cross-sectional shapes for preferred alternative racket frames according to my invention;

FIG. 16 is an elevational view of a fragment of the racket frame of FIG. 15; and FIG. 17 is a fragmentary plan view of a preferred embodiment of a racket according to my invention with a wider frame strip section along its lateral sides.

DETAILED DESCRIPTION

My discovery of a better racket frame came about from several factors. First, I have been analyzing and working on tennis rackets for several years; and my work on the dynamics of racket strings, as explained in my U.S. Pat. No. 4,333,650, has led to considerable knowledge about string loads and forces involved in hitting a ball.

Added to this is my knowledge of structural mechanics, giving me insight into structures best suited to withstand stresses involved in tennis racket frames. From these I was able to devise an improved cross-sectional shape for a tennis racket frame as represented by the sections of FIGS. 2 and 3.

Figure 2:
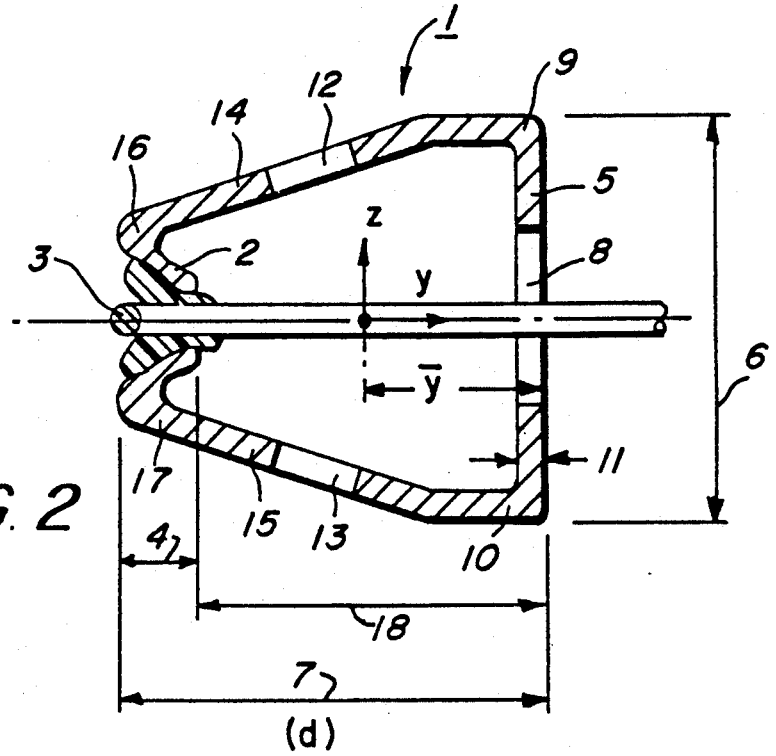
FIGS. 2 and 3 are cross-sectional shapes of racket frames made according to my invention and subjected to stress and stability analyses.
Figure 3:
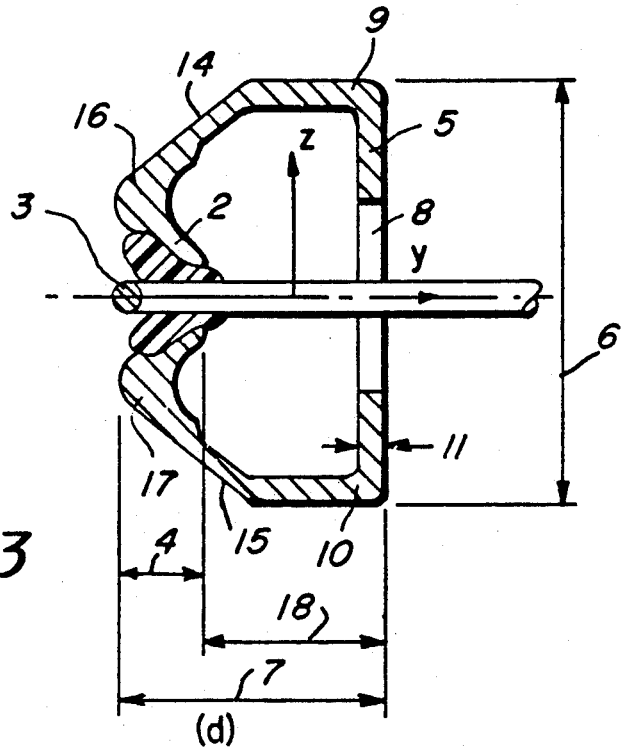
Figure 4:
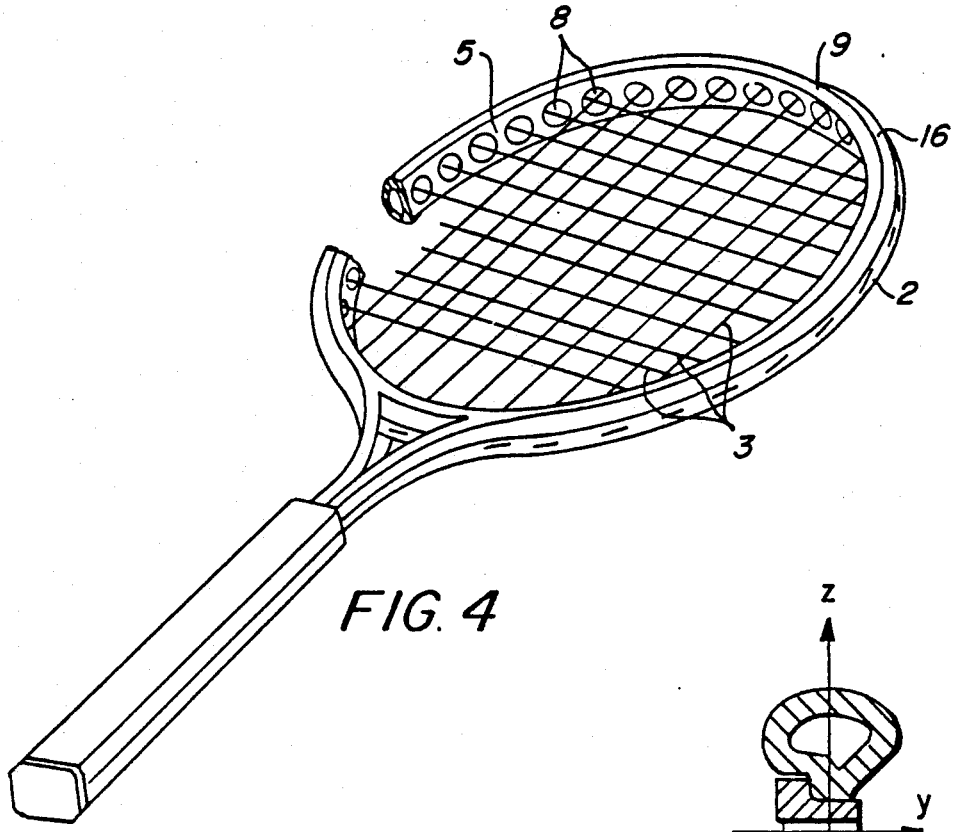
FIG. 4 is a perspective view of a preferred embodiment of a tennis racket made according to my invention.

By using analytical methods I was able to calculate the effectiveness of the sections of FIGS. 2 and 3 compared to the prior art section of FIG. 4. The analysis shows that the sections of FIGS. 2 and 3 and alternative structures shown in section in FIGS. 12–15 substantially improve over the prior art as explained below.

Generally, my improved frame anchors the strings at the outer perimeter of the frame strip and forms a support region of the frame extending inward from the outer perimeter toward the ball-hitting region. Providing the support or mechanical strength for the frame section in regions formed inwardly from the outer perimeter anchorage adds a small but significant extra length to the nominal string length an thus enlarges the free vibrational area of the string network for the same size racket head.

Analysis by FEM Method

To study and compare different tennis racket frame strip sections under actual stringing load and ball impact load, I performed a finite-element structural mechanical analysis (FEM). For this I used a conventionally shaped racket head approximately elliptical in its playing area and having a curved throat piece assumed to be the same as the frame strip.

Measured from the neutral axis of the frame strip, the major and minor radii of the ellipse are 6.43 inches and 5.53 inches, respectively. The two lateral sides converge to the handle, and the analysis assumes that the end of the grip towards the shank region provides a fixed-end support to the racket. Since the racket and the load are symmetric with respect to the longitudinal axis of the racket, only one-half of the racket needs to be meshed.

FIG. 1 shows the mesh of the analyzed racket. There are 34 beam elements in the analysis, which contains 35 nodes; and each node has six degrees of freedom, three translations, and three rotations. Nodes 1 and 29 are nodes to maintain symmetry with the right half of the racket. The throat piece is joined rigidly with the side frame at node 20. There could be another beam element to join the two parts at node 21 to 22, or from node 23 to 24, to make the frame more rigid. But this additional reinforcement will not affect appreciably the stress at nodes 29 and 35. So the additional beam is omitted, and the calculated result to estimate stress and deflection of the racket should be on the safe side.

Applied Loads from Stringing and Ball Impact

For the ball-hitting load, each node except nodes 1 and 29 in the elliptical circumference are loaded with a force of 2.174 pounds in the z direction of FIG. 1. The sum is 100 pounds at the center of the network. This static load is equivalent to a tennis ball having a weight of 2.04 ounces traveling at 80 mph and being stopped within 0.0046 seconds in a constant deceleration. If a frame can sustain this static load for an indefinite time, it should be able to sustain a transient load with a peak load of much greater magnitude. So, this 100-pound sustained load may be taken as a realistic field load on a racket to repeatedly sustain a volley at a 100 mph ball speed.

For the inplane string load, each node from node 2 to 9 and from 17 to 27 bears a longitudinal string, and each node from 5 to 21 bears a lateral string load. This produces 16 longitudinal and 16 lateral string loads, and the string force at each node is 80 pounds.

Analyzed Frame Strip Sections of FIGS. 2–4

FIGS. 2 and 3 show preferred cross-sectional shapes made according to the invention for frame strips analyzed and compared with a prior art frame as explained below. As is apparent from the wider frame section of FIG. 2 and the narrower frame section of FIG. 3, there can be differences in shapes, sizes, and wall thicknesses; and such differences can be affected by manufacturing methods, materials, head sizes, and racket weights. Governing principles in selecting such alternatives remain the same and are explained below.

Section 1 of FIG. 2 has a string hole or grommet seat 2 located at the outer perimeter where string 3 enters the frame and leads into the network. The width 4 of seat 2 is as short as possible, about 0.2 inches or less. There is ample opening or cutout at the inner perimeter 5 to let the string vibrate without interference. The height 6 in the sections of FIGS. 2 and 3 is about 0.80 to 1.0 inch, but it can be reduced when stronger material than the Alcoa 6061-T6 is used. The width 7, designated as d, is 1.0 inch for section 1 of FIG. 2 but can vary from 0.45 to 1.2 inches, depending on objectives. In the analysis, the height 6 is taken as 1.0 inch and d is varied from 0.45 to 1.0 inch. For widths 7 less than 0.45 inches, the design will not yield enough effective string length increase to benefit the performance. Widths greater than 1.2 inches will make the frame strip too bulky.

The string clearance opening 8 can be round, oval, or rectangular in shape; and each string can have its own opening, or use an enlarged opening to accommodate several strings, so that in between holes 8, there is ample material to form a web to connect the upper side region 9 and lower side region 10. The material removed from opening 8 can be added to the web between the neighboring openings, so that the wall thickness 11 can be the same as the side regions 9 and 10, whose thickness in section 1 is preferably about 0.055 inches for aluminum, for example.

If the material is very strong, such as graphite, and the upper and lower side regions 9 and 10 are stiff enough, inner perimeter 5 can form a continuous angle section with sides 9 and 10; and no web is needed for connecting the two sides at the inner perimeter. To keep a frame weight within accepted limits and still accommodate a frame having a 1.0 inch width 7 as shown in FIG. 2, I prefer weight-reducing openings 12 and 13 formed in side regions 9 and 10 respectively. Although openings 8, 12, and 13 are all illustrated in section 1 for convenience, in actual practice, I prefer staggering or spacing openings 8, 12, and 13 along the length of a frame strip so that they do not all lie on a single section, for evenly distributing the material and strength along the frame strip length.

In the analysis, I assume the removed material of the openings 8, 12, and 13 has the same volume as the remaining material in the walls. Then I assume a uniform wall thickness, 0.025 inches, to be used in the analysis with the local opening assumed as being eliminated. This "smeared average" method of dealing with local irregularity in wall thickness is well accepted in structural analysis. This is true especially for estimating local structural instability to which a thin-walled web connecting two strong, parallel flanges is often vulnerable.

Openings 12 and 13 can be round, oval, or rectangular in shape, with the remaining web extending between side regions 9 and 16 and between 10 and 17. Openings 12 and 13 can also be shaped as triangles, leaving panels between openings inclined as in a truss assembly. Then the frame will have its outer and inner perimeters supported by a plane truss on each side of the string plane. This can be structurally more rigid.

Openings 12 and 13 reduce weight, as well as reduce air resistance when the racket is swung. This may be necessary when the section width 7 is more than 0.7 inches. For narrower sections, one may simply omit the openings 12 and 13 and reduce the wall thickness to 0.025 inches as shown in the section of FIG. 3, where only opening 8 remains. This narrower section is especially adaptable to graphite rackets.

The description of FIG. 2 applies to the section of FIG. 3 except it has a shorter width 7, which is about 0.6 inches. In the FIG. 3 section, there are no air openings 12 and 13. All wall thicknesses are the same as the larger width section of FIG. 2. The side regions 9 and 10 in FIGS. 2 and 3 are 0.25 inches wide and 0.055 inches thick, and side regions 16 and 17 are 0.2 inches wide and 0.055 inches thick. These are continuous flanges providing major bending rigidity to resist moments due to the string and ball impact loads. They also provide necessary mass to guard against damage when the racket hits the ground.

The thickness of string anchorage wall 2 at the outer perimeter of the frame section can be 0.035 inches for an aluminum section. Especially around the nose of the racket, a plastic cushion strip can be provided to resist court-scuffing damage. Side regions 14 and 15 can be inwardly curved or recessed along their outer surfaces to reduce damage when the racket hits the ground.

Due to the well balanced mass distribution, the inventive sections have extremely high ratios of strength to weight for torsion and bending in the two principal axes. These values were rigorously calculated and are reported next. Foamed polyurethane integral stuffing used to fill the internal space of the frame strip for damping purposes is an option, but its affect on strength and weight is not included. Although the sections of FIGS. 2 and 3 have the desired strength-to-weight ratios, changes are possible; and the invention is not limited to the illustrated sections.

Any variation in sectional shaped for frames according to the invention preferably keeps the string clearance depth distance 18 to a maximum. This string clearance depth is measured along a perpendicular to the frame section in the plane of the string network from the inner perimeter 5 outward to the point where a string 3 or grommet clears the inside of the outer perimeter anchorage region 2. In other words, the outermost point where a string 3 can vibrate free from interference with the anchorage region is preferably located as close to the outer perimeter 2 of the frame as possible, and vibrational clearance is preferably provided for the strings from that point inward toward the ball-hitting region. The importance and extent of vibrational clearance for strings 3 is explained more fully below.

A racket having a generally conventional shape and made with a frame strip having a cross-sectional shape such as shown in FIGS. 2 and 3 is illustrated in FIG. 4. The cross-sectional shape of the frame strip used in the racket of FIG. 4 can be formed as an extrusion or draw in which string openings 8 are bored, or it can be formed as an open channel extrusion to which an inner perimeter wall with preformed openings 8 is secured. Wood and graphite frames can vary from this, and different construction possibilities are explained more fully below.

Analysis of Frame Sections

To determine the physical properties of different sections, I carried out rigorous analysis based on structural mechanics for the sections shown in FIGS. 2 and 3 and for a prior art section of FIG. 5.

Torsion Rigidity; Torsional rigidity of a one-cell box with variable wall thickness, as shown in FIGS. 2 and 3, is given by the following equation;

$$\theta = \frac{T}{G\,J_{eff}}$$

$$J_{eff} = \frac{4A_o^2}{\sum_{i=1}^{8} \frac{L_i}{t_i}}$$

where $\theta$ is the angle of twist per unit length, T is the torque applied, G is the shear modulus of the material, $J_{eff}$ is the effective polar moment of inertia, $A_o$ is the area bounded by the center line of the box, $L_i$ is the length of a particular segment, and $t_i$ is its wall thickness with i as the subscript index of that particular segment. There are eight segments of different wall thickness in the sections of FIGS. 2 and 3.

The shear stress at web 5 which is vulnerable to local instability is given by:

$$S_s = \text{Shear Stress} = \frac{T}{2A_o}\ \frac{1}{t}$$

FIG. 5 shows a prior art drawn aluminum frame strip section presently used in the HEAD EDGE medium-sized head racket. This particular section, as detailed in U.S. Pat. No. 3,899,172, issued August 1975, was said to have a very high strength-to-weight ratio. In the disclosure, the strength ratio of I/A, which is the moment of inertia to the cross-sectional area ratio, was said to range from 0.0516 inches$^2$ to 0.0580 inches$^2$. For comparison purposes, I enlarged FIG. 2 of the patent fourteen times and calculated its geometrical properties. It turned out to have an area A=0.112 inches$^2$, $I_y/A$=0.05296 inches$^2$, and $I_z/A$=0.00683 inches$^2$, which, excluding $I_z/A$, agreed with the claims.

The effective polar moment of inertia, as related to St. Venant torsion of two-tubes-connected-by-a-web type section, can be found from the following formula:

$$J_{eff} = \text{Torsional Inertia} = \frac{1}{3}\left(L_2^3 t_2 + \frac{24A_o^2 t_1}{L_1}\right)$$

where $L_2$ is the length of the web, $t_2$ is the web's thickness, $A_o$ is the area bounded by the centerline of the tubular hole, $t_1$ and $L_1$ are the wall thickness and the circumferential length of the tubular hole, respectively. With the measured quantities substituted into the above equation, we have for the prior art section:

$$J_{eff}=0.002085 \text{ inch}^4$$

The maximum shear stress at the web occurs at a point on the outer boundary of the web on the y-axis, as shown in FIG. 5. With the applied torque designed at T, the shear stress is:

$$S_{smax} = \frac{3L_2^2L_1}{t_2\,(L_2^3L_1t_2 + 24A_o^2t_1)} = 423.8\ T$$

The moment of inertia about the y and z axes for the inventive section and for the prior art section of FIG. 5 can be obtained by the usual method. Table 1 shows the section properties where d is the width 7 of the section in FIGS. 2 and 3, varied from 0.45 inches to 1.0 inch.

TABLE 1

| | SECTION PROPERTIES | | | | |
|---|---|---|---|---|---|
| | $I_y$ | $I_z$ | $\bar{y}$ | A | $J_{eff}$ |
| Prior Art Section, U.S. Pat. No. 3,899,172 | 0.0059 | 0.00077 | 0.1700 | 0.1120 | 0.0020 |
| Inventive Section | | | | | |
| d = 0.45" | 0.0089 | 0.00295 | 0.1600 | 0.0905 | 0.0075 |
| d = 0.60" | 0.0093 | 0.00503 | 0.2280 | 0.0958 | 0.0108 |
| d = 0.70" | 0.0097 | 0.00729 | 0.2730 | 0.0999 | 0.0130 |
| d = 0.80" | 0.0101 | 0.01010 | 0.3180 | 0.1043 | 0.0153 |
| d = 0.90" | 0.0105 | 0.01340 | 0.3650 | 0.1089 | 0.0175 |
| d = 1.00" | 0.0110 | 0.01730 | 0.4120 | 0.1136 | 0.0197 |

Nomenclatures:
$I_y$ = Moment of inertia about y-axis, inch$^4$
$I_z$ = Moment of inertia about the neutral axis, z-axis, inch$^4$
y = Neutral axis location, inch
A = Sectional material area, inch$^2$
$J_{eff}$ = Torsional moment of inertia, St. Venant torsion, inch$^4$
d = Width of the cross section, inch (FIGS. 2 and 3)

TABLE 2

| COMPARISON OF RATIO OF STRENGTH TO AREA | | | |
|---|---|---|---|
| | $I_y/A$ | $I_z/A$ | $J_{eff}/A$ |
| Prior Art | 0.0527 | 0.0069 | 0.0179 |
| Inventive Section | | | |
| d = 0.45" | 0.0983 | 0.0326 | 0.0829 |
| d = 0.60" | 0.0971 | 0.0522 | 0.1127 |
| d = 0.70" | 0.0971 | 0.0731 | 0.1300 |
| d = 0.80" | 0.0968 | 0.0968 | 0.1467 |
| d = 0.90" | 0.0964 | 0.1230 | 0.1607 |
| d = 1.00" | 0.0968 | 0.1523 | 0.1734 |

TABLE 3

| STRENGTH-TO-AREA RATIO INVENTIVE SECTION VERSUS PRIOR ART | | | |
|---|---|---|---|
| | $I_y/A$ Ratio | $I_z/A$ Ratio | $J_{eff}/A$ Ratio |
| d = 0.45" | 1.87 | 4.72 | 4.63 |
| d = 0.60" | 1.84 | 7.57 | 6.30 |
| d = 0.70" | 1.84 | 10.59 | 7.26 |
| d = 0.80" | 1.84 | 14.03 | 8.20 |
| d = 0.90" | 1.83 | 17.83 | 8.98 |
| d = 1.00" | 1.84 | 22.07 | 9.69 |

Table 2 is the strength-to-area ratio calculated from Table 1, and Table 3 is the ratio of comparison of strength-to-area ratio based on Table 2, with the strength ratio of the prior art section of FIG. 5 taken as the base for comparison.

Table 3 shows that the inventive frame strip is far superior to the prior art frame strip in all respects. Consider the inventive section having a width of 0.6 inches and a sectional shape as shown in FIG. 3, for example. This section is relatively narrow and does not need air holes in the side regions 14 and 15. Its cross section is 14.5% lighter than the prior art section. With Alcoa 61S-T6 taken at 0.098 lb./in.$^3$ for a frame strip length of 46 inches, the saving in weight of a complete racket is about 1.17 ounces, which is about 9.4% of the total weight.

In addition, as clear from Table 3, the inventive racket is 84% more stiff than the prior art racket in resisting ball impact load. This makes the returning ball fly back faster. The inventive section is also 657% more stiff in resisting inplane load. This not only makes the racket extremely strong against permanent deformation during stringing, but also helps to make the racket more rigid in resisting the ball load. When the string network tightens to resist the penetration of the ball, it not only bulges out to contain the ball, but each string has to pull inward toward the center of the net. A racket having a stiffer inplane rigidity, which is represented by its $I_z$ value, will make the net hard to be pulled inward toward its center, hence a stiffer frame allows the network to store more energy and impart its larger stored energy to the rebounding ball.

The inventive racket is also 530% more stiff in torsion. This ridigity reduces the "whippy" feeling of a racket, which affects player accuracy and reduces the strain energy loss to the frame.

The inventive racket also increases the free vibration area of the string network by increasing the free vibration length of its strings. Since the strings are anchored at the outer perimeter region of the frame and the support region, which includes the inner perimeter of the frame, does not interfere with free vibration of the strings, the strings have a free vibration length that extends within the frame section to the region of the string anchorage at the outer perimeter.

This is illustrated schematically in FIG. 6 where the dimension $L_s$ applied to all the strings of the network defines a net area commonly called the "string area" or "playing area" of a racket. The smaller dimension $L_b$ of FIG. 6, when applied tot he racket strings, defines the net area that a ball can actually touch. This is an area bounded by the frame and the throat minus an outer band width equal to the radius of the ball.

The free vibrational length of the strings is shown by the longer dimension $L_f$ extending for the full length of each string between the points where the string clears its anchorage at the outer perimeter of the racket frame. This dimension $L_f$ applied over all the strings of the network gives a larger free vibration area than the conventional "string area" based on the dimension $L_s$ for prior art rackets.

Applying this to the inventive section having a width of 0.6 inches and a sectional shape as shown in FIG. 3, string length increases make the free vibrational length $L_f$ of the strings longer than the conventional string length $L_s$ by an increase of $2(0.6-0.2)=0.8$ inches. Applying this longer free vibrational string length to a racket width a medium-sized head having major and minor radii of 5.67 and 4.77 inches respectively, for example, the increase in the free vibration area of the string network over the prior art is 16%. Even though the "string area" within the inner perimeter of the frame remains the same as before, the 16% increase in the free vibration area of the string network is an increase that the racket can use effectively.

Even in the narrower d=0.45 inch case of Table 1 where the inventive section strip width is about the same width as a conventional extrusion, the increase in the free vibrational area is about 10%. An over-sized head for a conventional racket has only about 29% more playing area than a medium-sized head racket. So, applying even a narrow form of the inventive racket frame to a medium size racket head to increase the free vibration area of the string network by 10%, when accompanied by a frame section that is 87% and 372% stronger respectively in bending stiffnesses and 363% stiffer in torsion as shown in Table 3 and 19% lighter in weight as shown in Table 1, produces a substantial improvement over the prior art. Also, a medium-sized head racket having an inventive frame strip with a width of 0.92 inches has a string network with a free vibration area equal to a conventional over-sized head racket. The resulting medium-sized racket head is half an inch narrower in its overall width than an oversized racket head and does not look as large, even though it performs at least as well.

Ordinarily, by comparison of the principal moment of inertia about the three axes and the strength-to-weight ratio of the inventive section with prior art sections, a merit comparison could be established and there would be no need to analyze stress from actual loads on the racket. However, since the inventive section improves its strength-to-weight ratio by distributing the mass away from its center to increase the moment of inertia while leaving the interior open to admit the vibrating string without interference, some segments of the wall of the section have to be thinner than the prior art walls. Consequently, I have studied the critical stress cases to show that the inventive section is indeed adequate to resist such particular failure modes.

Based on the finite-element method applied on the racket as shown in FIG. 1, results of the loading of the racket frame from an 80-pound string load case and a 100-pound ball load are obtained and shown in FIGS. 7 to 10.

Figure 7:
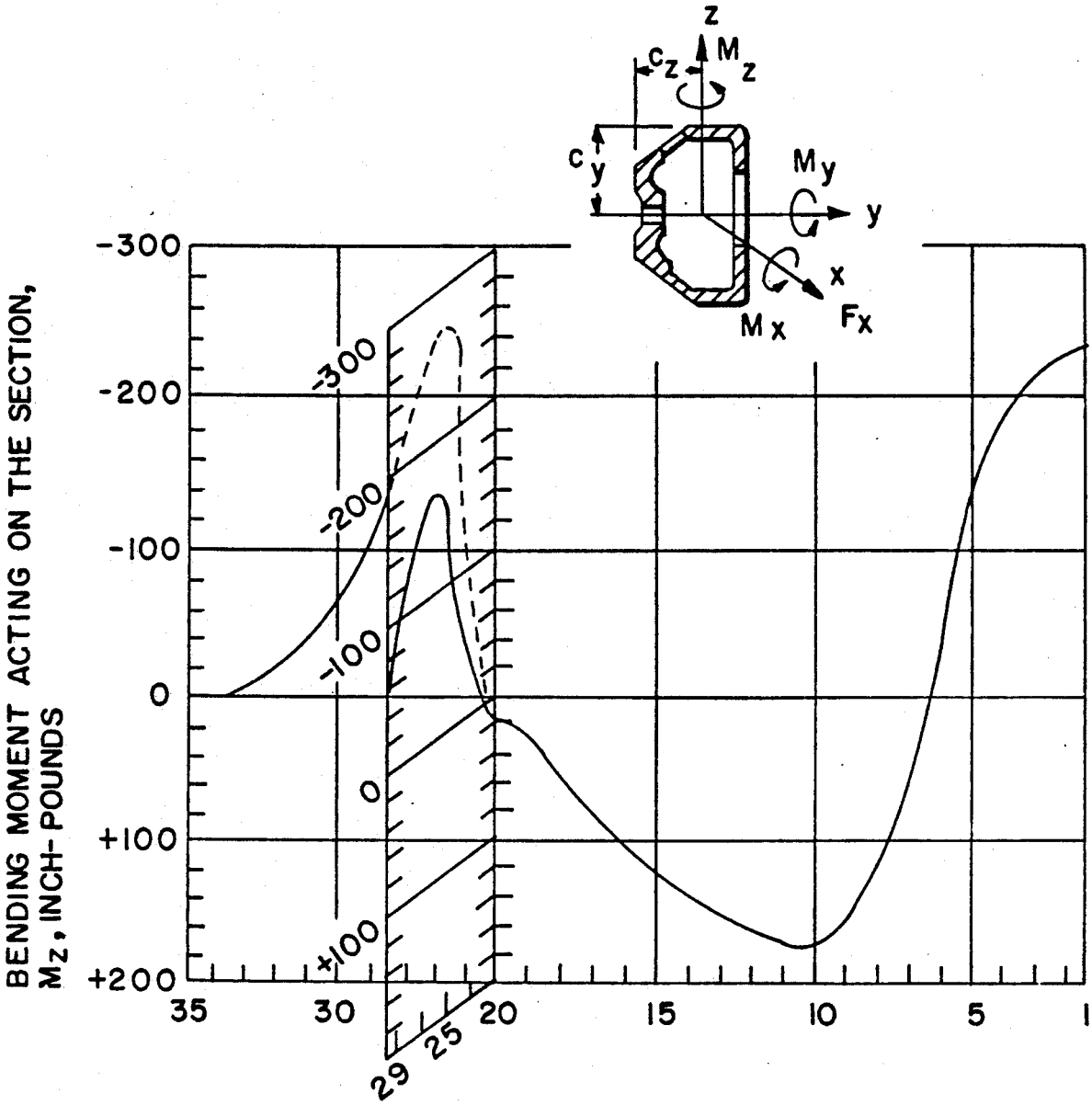
Figure 8:
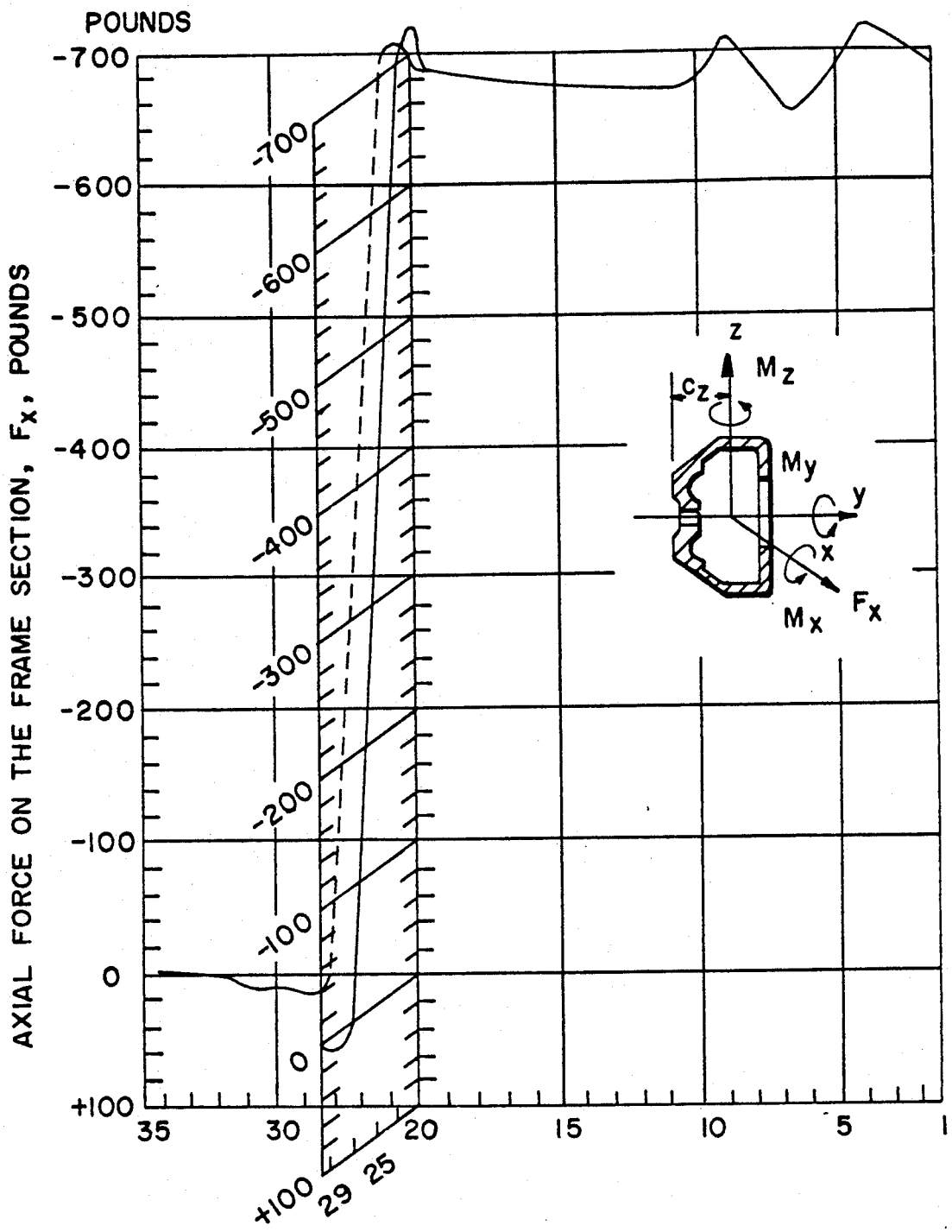

FIGS. 7 and 8 respectively depict the bending moment at each nodal section about the local z-axis and the axial force. The shear force can be obtained from the equilibrium of moments at the two ends of an element. The shear is quite small, however, and is neglected. From FIGS. 7 and 8, it is clear that the stringing load on the frame is maximum at node 1, with a magnitude of 240 inch-pounds for the 80pound string tension system. The axial force is compressive and is almost uniform at about 700 pounds from node 1 to 20 at the throat bracket.

Based on Table 1 properties of the sections, the bending stress is maximum at the outer perimeter of a section with $c_z$ as the distance from the neutral z-axis. The stress is $M_z c_z/I_z$, where the $c_z/I_z$ value of the prior art section and of the inventive section with a width d=1.0 inch are respectively 222 inches$^{-3}$ and 34 inches$^{-3}$. The maximum bending stress for the two sections are also in that ration, which is a ratio of six to one in favor of the inventive section. Since the cross-sectional areas A of each section are almost equal, the axial compressive stress is almost the same.

To investigate local instability of the inventive section at its inner perimeter due to the combined bending and axial force, I obtained the combined stress from the following (using $c_z$=0.412 for inner periphery):

$$s_c = M_z c_z / I_z + F_x / A = 240 \times 0.412/0.173 + 700/0.1136 = 11{,}880 psi$$

at node 1. From a classical buckling equation ("Theory of Elastic Stability", by Timoshenko and Gere, Second Edition, page 366), for a thin plate supported by strong parallel flanges and compressed uniformly along the flange direction at the ends, the critical stress the web can sustain is:

$$(s_c)\ cri. = 7.0 \frac{\pi^2 E h^2}{12 b^2}$$

For the inventive section, E=$10^7$ for aluminum, h=0.025 inches for web thickness, and b=0.88 inches for web height, the critical stress allowed is 40,890 psi. Compared with the actual stress of 11,880 psi from the 80-pound string force system, the local instability of the thin web is of no concern at all. On the other hand, the combined compressive bending stress at node 1 for the prior art section is more than 50,000 psi.

When the contour geometry of the racket based on the neutral axis line of the racket frame is fixed, the difference in the frame strip properties do not appreciably change the loadings on the frame from the ball or string load. This means that loadings due to external force on the inventive racket and on the prior art racket are approximately the same, but stress and displacement are different.

Furthermore, the loads on the sections are linearly proportional to the applied loads. For example, if the bending moment acting at node 1 from the 80-pound string load system is 240 inch-pounds, then the moment becomes 300 inch-pounds when the string load system is increased to 100 pounds each, with all the other things remaining the same. The load from the ball impact similarly increases the bending moment. Therefore, the information revealed in FIGS. 7 to 10 affords a very useful loading reference for a tennis racket of conventional size and shape.

Figure 9:
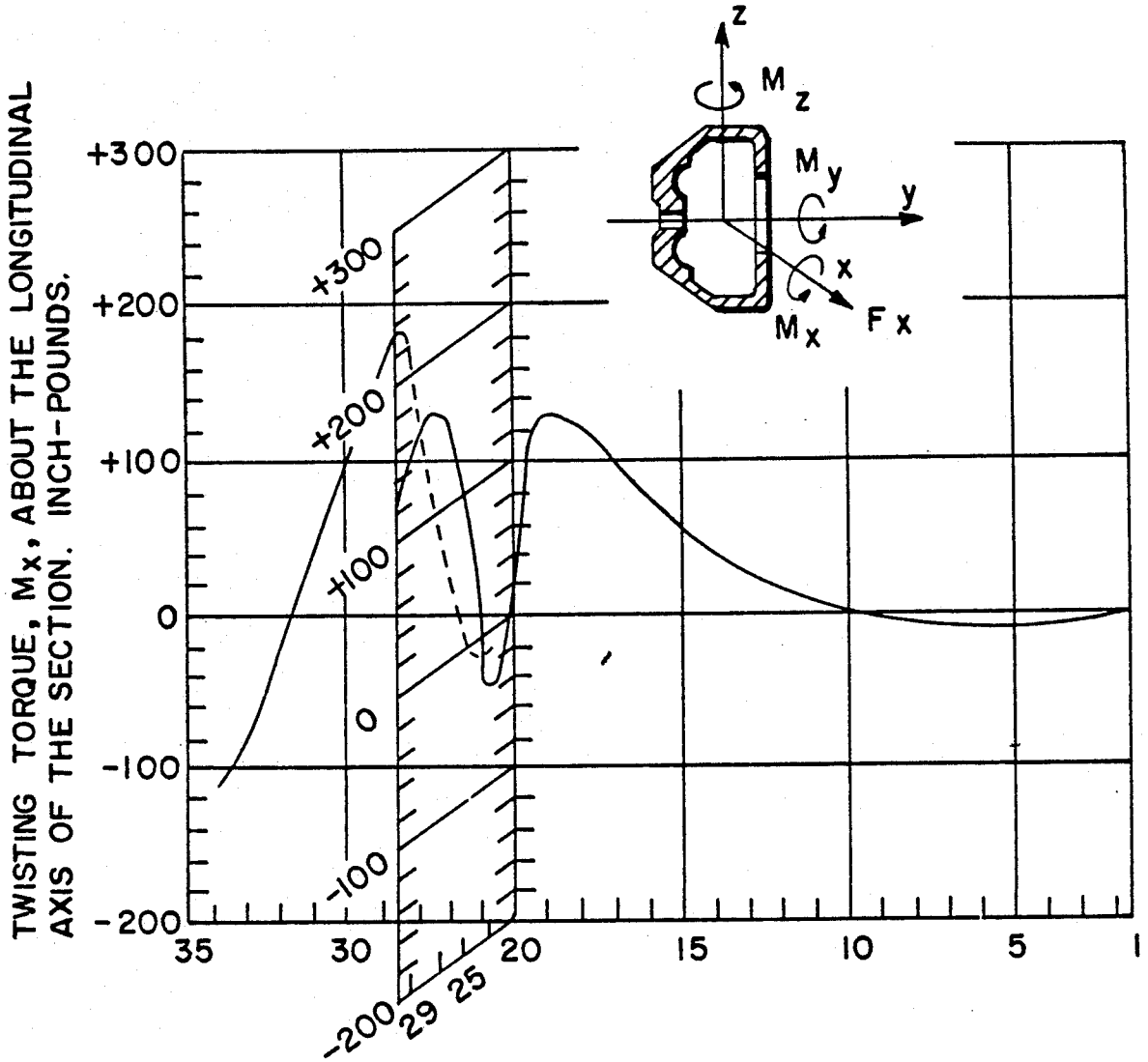
Figure 10:
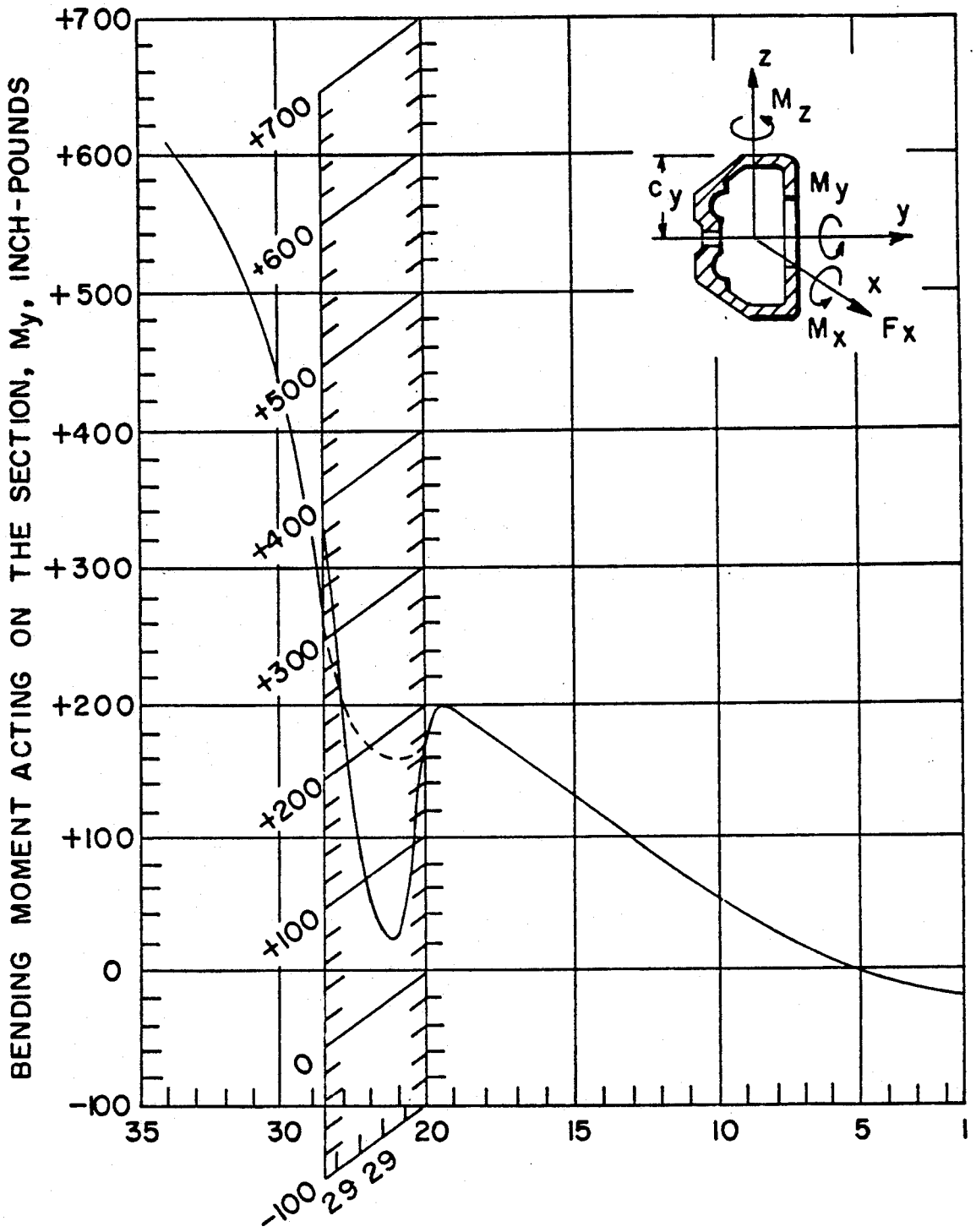

FIGS. 9 and 10 show loads on the frame strip at different node points from the impact of the ball. The ball impact produces no axial force along the longitudinal axis of a section, but it produces two bending moments. One is a twisting or torque moment, $M_x$, about the longitudinal axis of the section. The twist in the shank region beyond node 20 can be reduced by stiffening the throat piece. The maximum twisting torque is at node 19, which is about 130 inch-pounds in magnitude.

The maximum bending about the local y-axis from FIG. 10 occurs at the handle node 35 where $M_y$ is 610 inch-pounds. The material distance to inertia ratios, $c_y/I_y$, for the prior art section and for the inventive section with a width of d=1.0 inch are respectively 63.6 inches$^{-3}$ amd 45.5 inches$^{-3}$. Consequently, their maximum stresses are also in that ratio.

Therefore, the maximum material stress of the inventive section is only 71% of the prior art section, regardless of the actual size of the moment For the 610 inch-pounds bending moment, the stresses are 38,600 and 27,700 psi, respectively, in favor of the inventive section.

FIG. 11 shows the lateral deflection at node 1, at the nose of an aluminum racket, for a ball impact load of 100 pounds. The prior art section deflects twice as much as the inventive section at different section widths d. Stiffer material can reduce the deflection, but the ratios remain, and the deflection is proportional to different impact forces. For determining relative merits, comparisons between strength-to-weight ratios and magnitudes of stress and displacement for the inventive section and the prior art section are more important than absolute magnitudes, per se.

The inventive frame section shapes shown in FIGS. 2 and 3 and subject to the foregoing analysis, principally apply to medium and large size racket heads with frames made of metal, graphite, and other high strength to area ratio materials. These especially accommodate a hollow-walled chamber shape of frame strip that can be used to advantage for stiffness, strength, and longer effective string lengths. Several variations from the shapes shown in FIGS. 2 and 3 are also possible and practical for these materials as illustrated in FIGS. 12–14.

Figure 12:
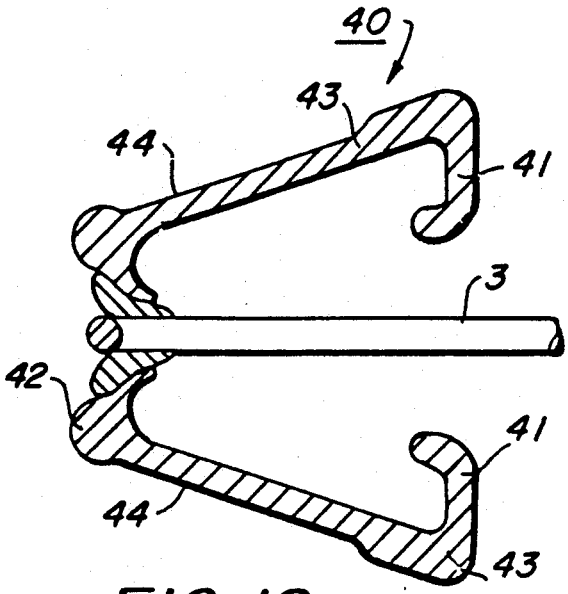

Frame section 40 of FIG. 12 is formed as an open channel with inturned edges 41 and no inner perimeter wall. A string anchorage web 42 is arranged at the outer perimeter of section 40 and supports strings 3. Support regions 43 extending inward from anchorage region 42 on opposite sides of the plane of the string network provide strength and rigidity as explained above. Side regions 43 and inturned channel edges 41 also clear strings 3 and allow them to vibrate freely for effectively increasing the free vibrational length of strings 3 to the region of their anchorage at outer perimeter 42. The outer surfaces of side support regions 43 have shallow recesses 44 extending along the length of the frame to guard against damage when the frame is scuffed against the court.

Figure 13:
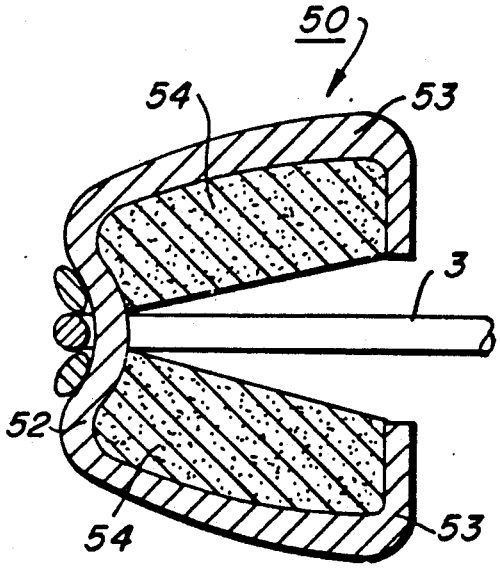

Frame section 50 of FIG. 13 is also formed in an open channel configuration and is rounded and curved, rather than angular. Its string anchorage region 52 is also at its outer perimeter, and its supporting side regions 53 extend inward on opposite sides of the plane of strings 3 Except for clearance around strings 3, the interior of frame strip 50 is filled with a foamed resin material 54 that helps stiffen and strengthen the frame. String 3 vibrates clear of resin 54 all the way to the region of its anchorage at outer perimeter web 52.

Figure 14:
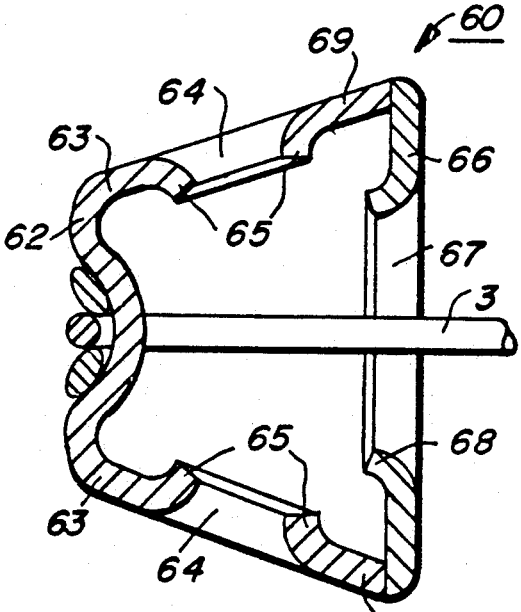

Frame 60 of FIG. 14 is similar in overall shape to frame section 1 of FIG. 2. Its anchorage web 62 is also at its outer perimeter and supports strings 3. Openings 64 formed in supporting side regions 63 have edges 65 that are formed to bend inward as illustrated. This helps strengthen side regions 63 around opening 64.

Instead of an integral inner perimeter wall, section 60 has an inner perimeter wall 66 forced as a separate strip perforated with openings 67 having inturned edges 68 as illustrated and securely attached to the inner edges 69 of side regions 63. Wall 66 and side edges 69 can be secured together by welding, for example. Such construction allows perforations 64 and 67 to be die shaped with inturned edges 65 and 68 for greater strength and smooth outer surfaces. As with other preferred embodiments, string 3 can vibrate clear of support regions 63 and inner perimeter wall 66.

The invention can also be applied to solid frame tennis rackets made of solid materials such as laminates of wood, resins, fiber-reinforced composite materials, and graphite. An example of this is illustrated by the inventive section 70 of FIG. 15. Although section 70 can be square or rectangular in cross section as is conventional for racket frames of solid materials, it is shown in FIGS. 15 and 16 as a regular trapezoidal shape that advantageously positions its strength supporting material toward its inner perimeter 71. Also, section 70, in addition to conventional laminates 74 formed of wood, can have an outer laminate 72 in the string anchorage region at the outer perimeter of the frame section and an inner laminate 73 formed of a higher strength material such as a resin. Not only are laminates of different materials possible, but cross-sectional shapes for solid frame rackets can be varied to take advantage of the inventive discoveries.

Openings 75, preferably formed as tapered ovals to remove as little frame material as possible, provide clearance within frame section 70 for free vibration of strings 3. This achieves the important advantage of extending the free vibrational length of strings 3 to the region of their anchorage at outer perimeter 72.

Solid frames formed of wood and other laminates as shown in FIG. 15 are especially suitable for conventional small head rackets. Although these afford a playing area of only 70 square inches, use of string clearance opening 75 can provide a free vibrational area for the string network of up to 86 square inches. This can allow the network to perform with a larger dynamically vibrating area equivalent to a medium-sized head racket. The increase in the racket head's overall width and length is only 0.4 inches.

Small size head rackets have a substantial appeal because the small head allows the straight and narrow part of the handle to be very long for players who like to use two-handed grips. Medium and large size rackets have a flaring shank that effectively shortens the potential length of two-handed grips. The invention enables the small racket head to retain the two-handed handle advantage while enjoying the performance benefit of a free vibrational string network area equal to that of a medium size racket.

Racket frame sections are not necessarily uniform throughout the length of the frame and can vary in width and shape. Frame sections according to the invention can accommodate this and can be shaped to accommodate the loads encountered at different regions of a frame. For example, greater widths, thicknesses, and strengths are appropriate in the throat, shank, and lateral side regions and thinner widths, thicknesses, and strengths in the nose region of a racket.

Also, it is especially important for transverse strings of the string network to have maximum free vibrational length so that the string clearance depth of the frame section should be at a maximum along lateral side regions of the frame where transverse strings are anchored. Maximum string clearance depth is not so necessary for longitudinal strings anchored in the nose region of the racket. The elliptical shape of conventional rackets makes longitudinal strings longer than transverse strings anyway.

Greater width of the racket frame strip in the lateral side regions is also preferred for the advantage of increasing the moment of inertia of the racket about its longitudinal axis to counteract shots made off the longitudinal axis of the racket. Racket head 80 of FIG. 17 is formed of a frame strip 81 that is wider in lateral side regions 82 than in nose region 83 for accomplishing both objectives. The greater width of frame strip 81 in lateral side regions 82 not only increases the moment of inertia against a twisting moment, but also allows a greater string clearance depth. The inner perimeter 84 of frame strip 81 preferably has the same elliptical shape as a conventional racket head, and the widening of frame strip 81 in lateral side regions 82 is formed to increase the distance between the outer perimeter regions 85 where the transverse strings are anchored. This increases the free vibrational length of the transverse strings and makes them more effective components of the vibrating string network.

Widening of frame strip 81 in lateral side regions 82 is preferably sufficient to exceed the width of frame strip 81 in nose region 83 by at least 0.125 inches, and preferably by about 0.375 inches. Such widening also preferably increases the string clearance depth by the same amounts to increase the free vibrational length of the transverse strings while also increasing the moment of inertia of the racket about its longitudinal axis.

String clearance depth for the inventive racket is measured perpendicular to the frame strip and in the plane of the string network. This distance extends from the inner perimeter of the racket frame along the string plane in a direction perpendicular to the frame strip to the point where the strings clear and depart inwardly from their anchorage at the outer perimeter of the racket. Support regions of the racket frame section extending inward from the string anchorage at the outer perimeter clear the strings by a sufficient margin to allow their free vibration under normal playing conditions. Then the strings, instead of vibrating only within the area enclosed by the inner perimeter of the racket frame, vibrate throughout their entire length including their string clearance depth within the frame to the region where they contact their anchorage at the frame's outer perimeter.

The clearance of the support region from the strings is preferably sufficient to allow the strings to vibrate freely within an angle of at least 5° on either side of the plane of the string network. This means that the support regions of the frame, including the inner perimeter, preferably clear the strings by an angle of 5° on either side of the plane of the string network extending inward from the string anchorage region. Such a 5° clearance angle is adequate to accommodate string deflection in response to a normal ball impact load. An 7° clearance angle on either side of the plane of the string network is preferred for accommodating the most severe ball impact forces that a racket can be expected to encounter.

Within practical weight requirements that limit the cross-sectional area of the frame of up to about 0.112 inches$^2$ for aluminum alloy materials and up to about 0.177 inches$^2$ for graphite or other composite materials of similar specific weight, the inventive cross-sectional shape for a racket frame preferably has an intertia to area ratio about its z-axis ($I_z/A$) of between 0.11 to 0.19 inches$^2$ and about its y-axis ($I_y/A$) of between 0.06 to 0.10 inches$^2$ for a section having a height from 0.65 to 0.90 inches and a width of from 0.60 to 0.85 inches and a wall thickness of from 0.05 to 0.08 inches. Comparing this with the section of U.S. Pat. No. 3,899,172, which has an $I_z/A$ value of 0.0068 inches$^2$ and an $I_y/A$ value of 0.053 inches$^2$ as representative of the state-of-the-art for an aluminum alloy frame strip having a cross-sectional area of 0.112 inches$^2$, the inventive section is much superior in its strength to area ratios.

Racket frames made according to my invention enlarge and maximize the free vibrational area of the string network and thus clearly improve racket performance. My frames are also stronger, stiffer, and better able to withstand string load without being heavier. They are less likely to be deformed under stringing or ball impact load, are less whippy, and provide a larger sweet spot playing area.

I claim:

1. In a sports racket having a ball-hitting string network of longitudinal an transverse strings surrounded and supported by a hollow frame having a nose region, a throat region and two lateral side regions, the frame having a hollow structural form, the improvement wherein the frame has four sides: an outer peripheral side, an inner peripheral side and two opposed supporting sides extending on opposite sides of the plane of the string network and connecting the said outer peripheral side to said inner peripheral side; said supporting sides being formed with triangular-shaped openings leaving remaining panel sections of said sides inclined to form a truss configuration, whereby said outer peripheral side and said inner peripheral side will be supported by a plane truss on each side of the plane of the string network.

2. The sports racket as defined in claim 1 wherein the individual strings in the string network are mounted on said outer peripheral side.

3. The sports racket as defined in claim 1 wherein the cross-section of the frame being trapedzoidal with said outer peripheral side being narrower than said inner peripheral side.

4. The sports racket as defined in claim 1 wherein said supporting sides of the truss configuration are space on either side of the plane of the string network adjacent the mounting thereof to said outer peripheral side.

* * * * *